US006065248A

United States Patent [19]

Sasaki et al.

[11] Patent Number: 6,065,248

[45] Date of Patent: May 23, 2000

[54] CREMORNE LOCK MOUNTING DEVICE FOR WINDOW

[75] Inventors: Hiroyuki Sasaki; Koichi Segawa, both of Miyagi, Japan

[73] Assignee: YKK Architectural Products Inc., Tokyo, Japan

[21] Appl. No.: 08/938,155

[22] Filed: Sep. 26, 1997

[30] Foreign Application Priority Data

Jun. 30, 1997 [JP] Japan ..... 8-258746

[51] Int. Cl.[7] ..... E05B 65/06

[52] U.S. Cl. ..... 49/394; 49/449

[58] Field of Search ..... 49/449, 450, 394, 49/503

[56] References Cited

U.S. PATENT DOCUMENTS 4,098,024 7/1978 Naka ..... 49/246

4,443,973 4/1984 Naka ..... 49/395 X 4,593,493 6/1986 Naka et al. ..... 49/395 X 5,822,926 10/1998 Koike et al. ..... 49/394

*Primary Examiner*—Daniel P. Stodola

*Assistant Examiner*—Hugh B. Thompson

*Attorney, Agent, or Firm*—Finnegan, Henderson, Farabow, Garrett & Dunner, L.L.P.

[57] ABSTRACT

A cremorne lock mounting device for a window is capable of reducing width dimension of a frame of a window door and thus provide greater lighting area. A hollow portion extending over a frame body of the frame of the window door and a panel support portion is defined. A lock body of the cremorne lock is mounted within the hollow portion. Thus, the frame body is required smaller width dimension than a width dimension of the lock body.

7 Claims, 9 Drawing Sheets

CREMORNE LOCK MOUNTING DEVICE FOR WINDOW

BACKGROUND OF THE INVENTION

1. Field of the Invention

The present invention relates generally to a mounting device for a cremorne lock locking a pivotal window door pivotably mounted on a window frame. More specifically, the invention relates to a mounting device for a cremorne lock for a projected or sliding out window, an opening out window and so forth.

2. Description of the Related Art

As is well known, a cremorne lock drives a rod up and down by a lock body according to rotation of a handle to engage and disengage the rod to and from a lock receptacle. The handle, the lock body and the rod of the cremorne lock is mounted on a frame of a window door and the lock receptacle is mounted on a frame member of a window frame.

For example, as shown in FIG. 1, a vertical frame 1 forming the window door of a pivoted window, is provided a cross-sectional configuration having a panel mounting groove 6 by providing a panel support portion 4 on one side of depth direction (out-of-plane direction) and a panel support 5 on the other side of the depth direction, on the inner face 3 in the depth direction (out-of-plane direction) of a hollow frame body 2. A lock main body 8 is mounted within a hollow portion 7 of the frame body 2. Also, on an interior side face 9, a handle 10 is mounted. A rod 12 is mounted on the outer face in the width direction for movement there along.

A lock receptacle 15 is mounted on the inner face 14 in the depth direction of a vertical frame member 13 forming the window frame of the pivoted window. By rotating the handle 10, the lock main body 8 drives the rod 12 for movement up and down direction to engage and disengage with and from the lock receptacle.

Assuming that a width dimension a of the frame 1 is a sum of the width dimension b of the frame body 2, the width dimension c of the panel support portions 4 and 5, and the width dimension d of an exterior side projecting portion 16. On the other hand, in the conventional mounting device, the width dimension b of the frame body 2 becomes slightly greater than the width dimension e of the lock body 8.

The width dimension c of the panel support portions 4 and 5 is required a predetermined dimension in order to supply the panel. Also, the width dimension e of the lock body 8 has to be provided a given dimension in viewpoint of mechanism. Therefore, the width dimension of the frame 1 becomes large to make opening portion of the window door smaller to reduce a lighting area. Thus, the pivotal window should have smaller lighting area.

SUMMARY OF THE INVENTION

Therefore, it is an object of the present invention to provide a novel cremorne lock mounting device which can solve the problems set forth above.

According to the first aspect of the invention, a cremorne lock mounting device for a window comprises:

a frame forming a window door, the frame including a frame body and an one side panel support portion integrally provided on an interior side on an inner face of width direction of the frame body for defining a panel receptacle, the frame body and the one side panel support portion having a hollow portion continuous thereover in width direction; and a lock body of a cremorne lock mounting within the hollow portion.

According to the first aspect of the present invention as set forth above, since the lock body is mounted over the hollow portion of the frame body and the hollow portion of one side panel support portion, the width dimension of the frame body can be smaller than the width dimension of the lock body. By this, the width dimension of the frame can be made smaller to provide greater lighting area for the window door.

According to the second aspect of the invention, a cremorne lock mounting device for a window comprises:

a frame forming a window door, the frame including a frame body and an one side panel support portion integrally formed with the frame body on the interior side of an inner face in width direction of the frame body; and a lock body of a cremorne lock mounted over the frame body and the one side panel support portion.

According to the second aspect of the present invention as set forth above, since the lock body is mounted over the frame body and the one side frame support portion, the width dimension of the frame body can be smaller than the width dimension of the lock body. By this, the width dimension of the frame can be made smaller to provide greater lighting area for the window door.

BRIEF DESCRIPTION OF THE DRAWINGS

The present invention will be understood more fully from the detailed description given herebelow and from the accompanying drawings of the preferred embodiment of the present invention, which, however, should not be taken to be limitative to the invention, but are for explanation and understanding only.

In the drawings.

DESCRIPTION OF THE PREFERRED EMBODIMENT

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to avoid unnecessarily obscuring the view of the present invention.

Figure 1:
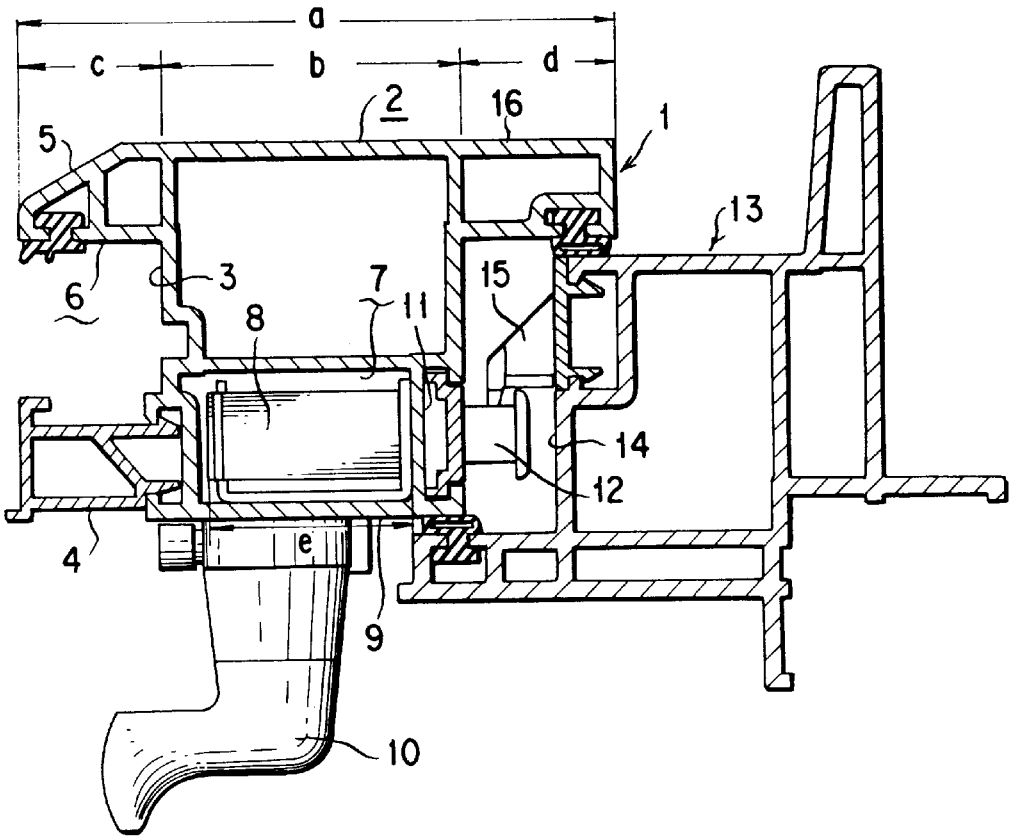
FIG. 1 PRIOR ART
FIG. 1 is a cross section showing one example of the conventional cremorne lock mounting device.
Figure 2:
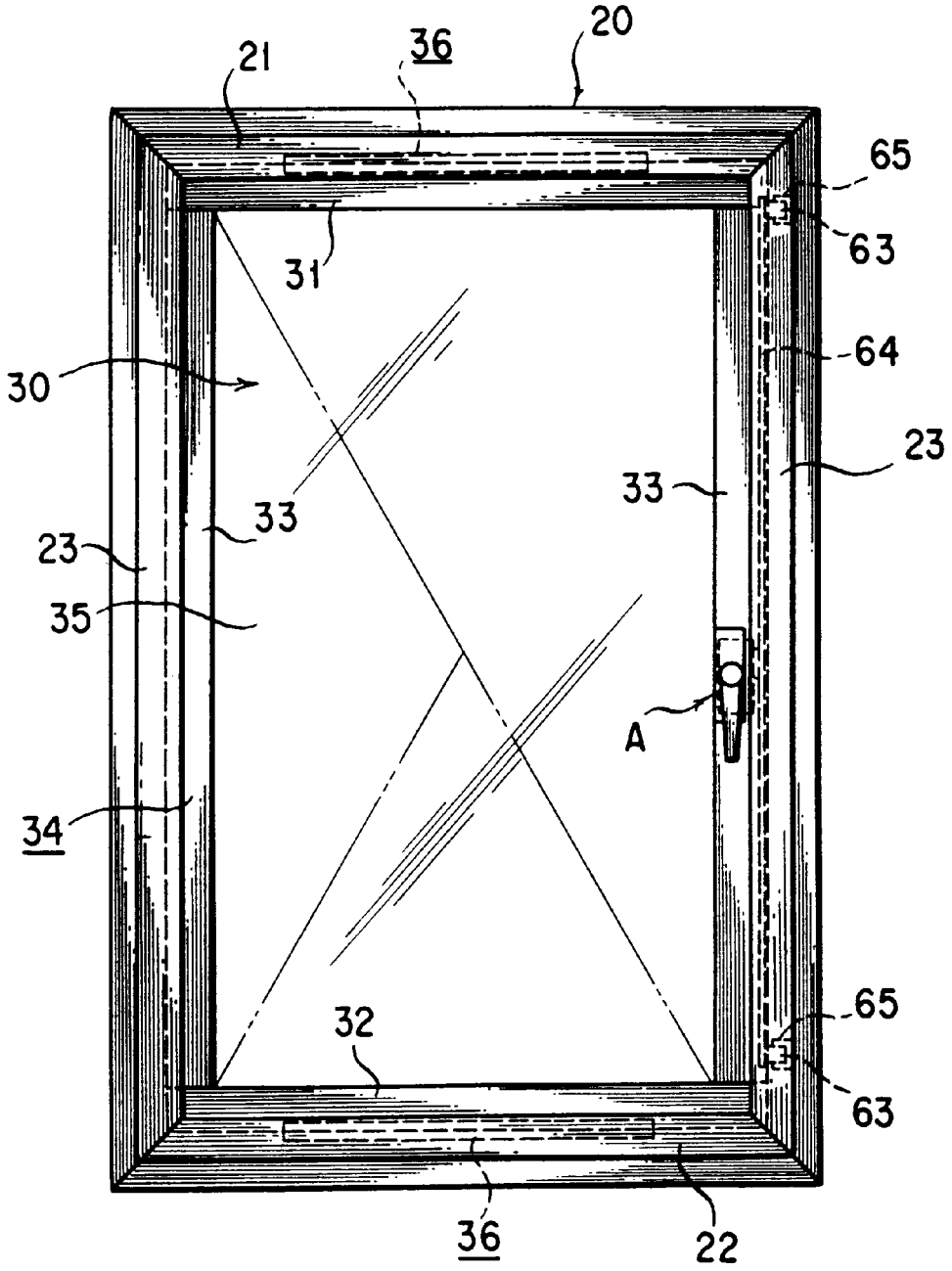
FIG. 2 is a front elevation of a vertical projecting or sliding out window as implementation of one embodiment of a cremorne lock mounting device according to the invention.

As shown in FIG. 2, a window frame 20 includes an upper horizontal frame 21, a lower horizontal frame 22 and left and right vertical frame 23 and is formed into a quadrangular shaped (rectangular shape in the shown case) configuration. Each of the frames 21, 22 and 23 has the same cross-sectional shape to others and includes a hollow frame body 24, an exterior side projecting portion 25 and an interior side portion 26.

A window door 30 includes an upper horizontal frame 31, a lower horizontal frame 32 and left and right vertical frames 33 which forms quadrangular frame 34, in which a window panel 35, such as a window pane, is received. Vertical sliding out hinges 36 are mounted between the upper horizontal frame 21 of the window frame and the upper horizontal frame 31 of the window door frame, and between the lower horizontal frame 22 of the window frame and the lower horizontal frame 32 of the window door frame for forming a projecting or sliding out window.

Figure 3:
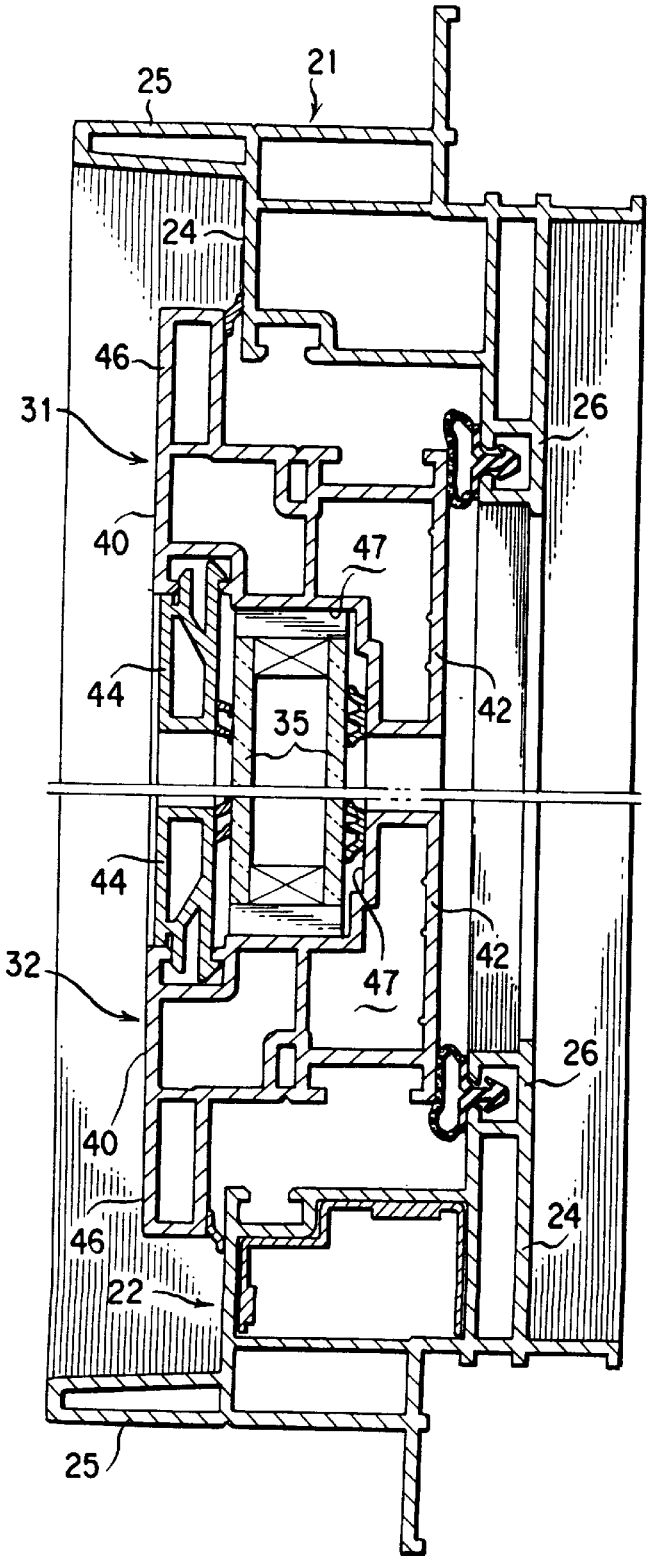
FIG. 3 is a longitudinal section of the cremorne lock mounting device of FIG. 2.
Figure 4:
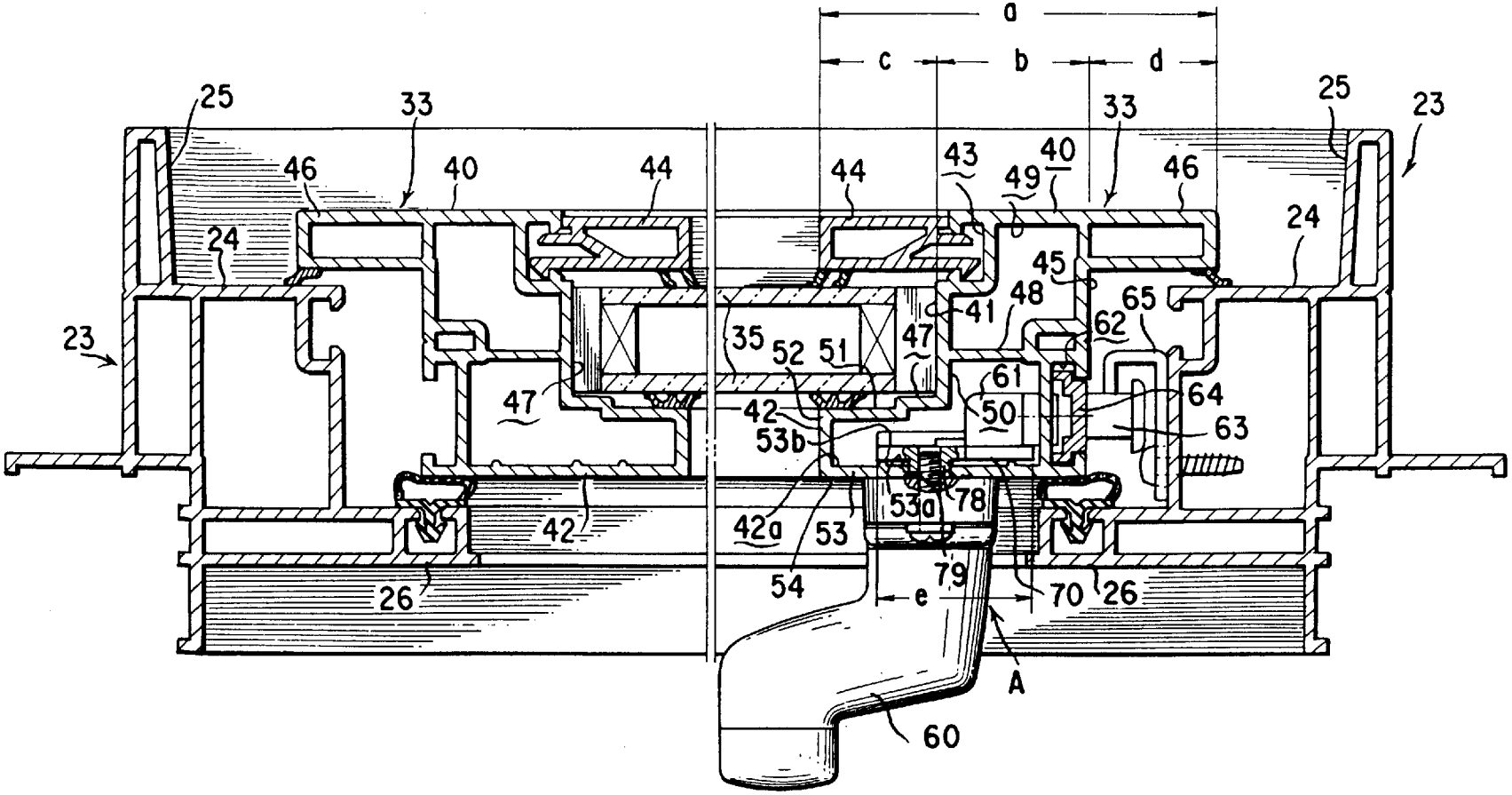
FIG. 4 is a cross section of the cremorne lock mounting device of FIG. 2.

As shown in FIGS. 3 and 4, each of the frames 31, 32 and 33 includes a hollow frame body 40, a hollow one side panel support portion 42 provided integrally with the frame body 40 at interior side of the inner face 41 in the width direction of the frame body 40, the other side panel support portion 44 releasably engaged with a recessed groove 43 formed on an exterior side on the inner face 41 in the width direction of the frame 40, and an exterior side projecting portion 46 provided integrally with the frame body 40 at the exterior side in the outer face 45 in the width direction of the frame body 40. It should be noted that the frames 31, 32 and 33 have the identical cross-sectional configuration.

A panel mounting groove 47 is defined by the one side panel support portion 42, the inner face 41 in the width direction of the frame and the other side panel support portion 44. A hollow portion of the frame body 40 is separated into an exterior side hollow portion 49 and an interior side hollow portion 50 by an intermediate partitioning wall 48. The interior side hollow portion 50 is continuous with a hollow portion 42*a* of the one side panel support portion 42.

In practice, an inwardly oriented panel 51 is integrally provided at the interior side on the inner face 41 in the width direction of the frame body 40. On the projecting end of the inwardly oriented panel 51, a panel 52 oriented in the depth direction is provided integrally to extend toward the interior side. On a projecting end of the panel 52, an interior side panel 53 is integrally provided. With the interior side panel 53, the panel 52 and the inwardly oriented panel 51, the one side panel support portion 42 is formed. The interior side panel 53 is extended to the outer face 54 in the depth direction of the frame body 40. Thus, the hollow portion 42*a* is continuous with a hollow portion 50.

As shown in FIG. 4, on an interior side face (interior side panel 53) of the frame body 40 of one of the left and right vertical frames 33, a handle 60 of a cremorne lock A is mounted. A lock body 61 of the cremorne lock A is mounted within the hollow portion 50 of the interior side of the frame body 40. A recessed groove 62 is formed at the interior side in the outer face 45 in the width direction of the frame body 40. Within the recessed groove 62, a lever body 64 having a rod 63 is slidably engaged. On the other hand, a lever body 64 carrying a rod 63 is slidably engaged with the recessed groove 62. The lock receptacle 65 is mounted on one of the left and right vertical frame 33.

As set forth above, one end portion in the depth direction of the lock body 61 is projected into the hollow portion 42*a* of the one side panel support portion 42. Thus, the width dimension b of the frame body becomes smaller than the width dimension e of the lock body 61. Accordingly, the width dimension of the frame 33 can be made smaller than that in the prior art.

Figure 5:
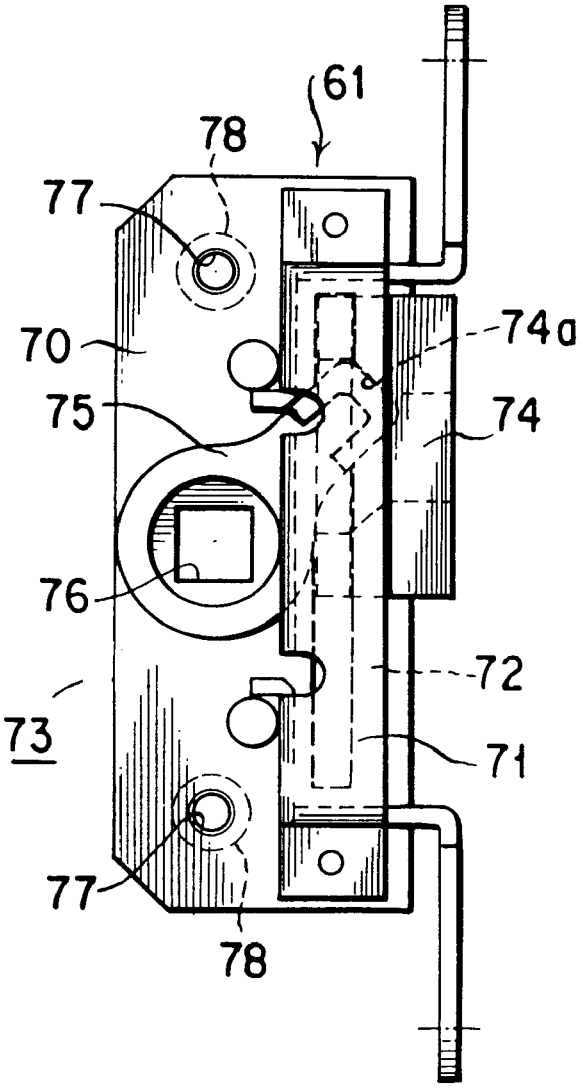
FIG. 5 is a front elevation of a lock body.
Figure 6:
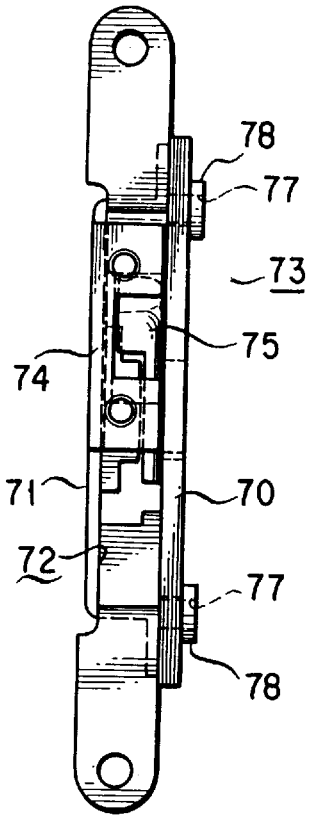
FIG. 6 is a right side elevation of the lock body of FIG. 5.
Figure 7:
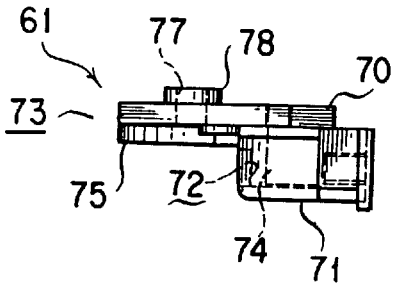
FIG. 7 is a plan view of the lock body of FIG. 5
Figure 8:
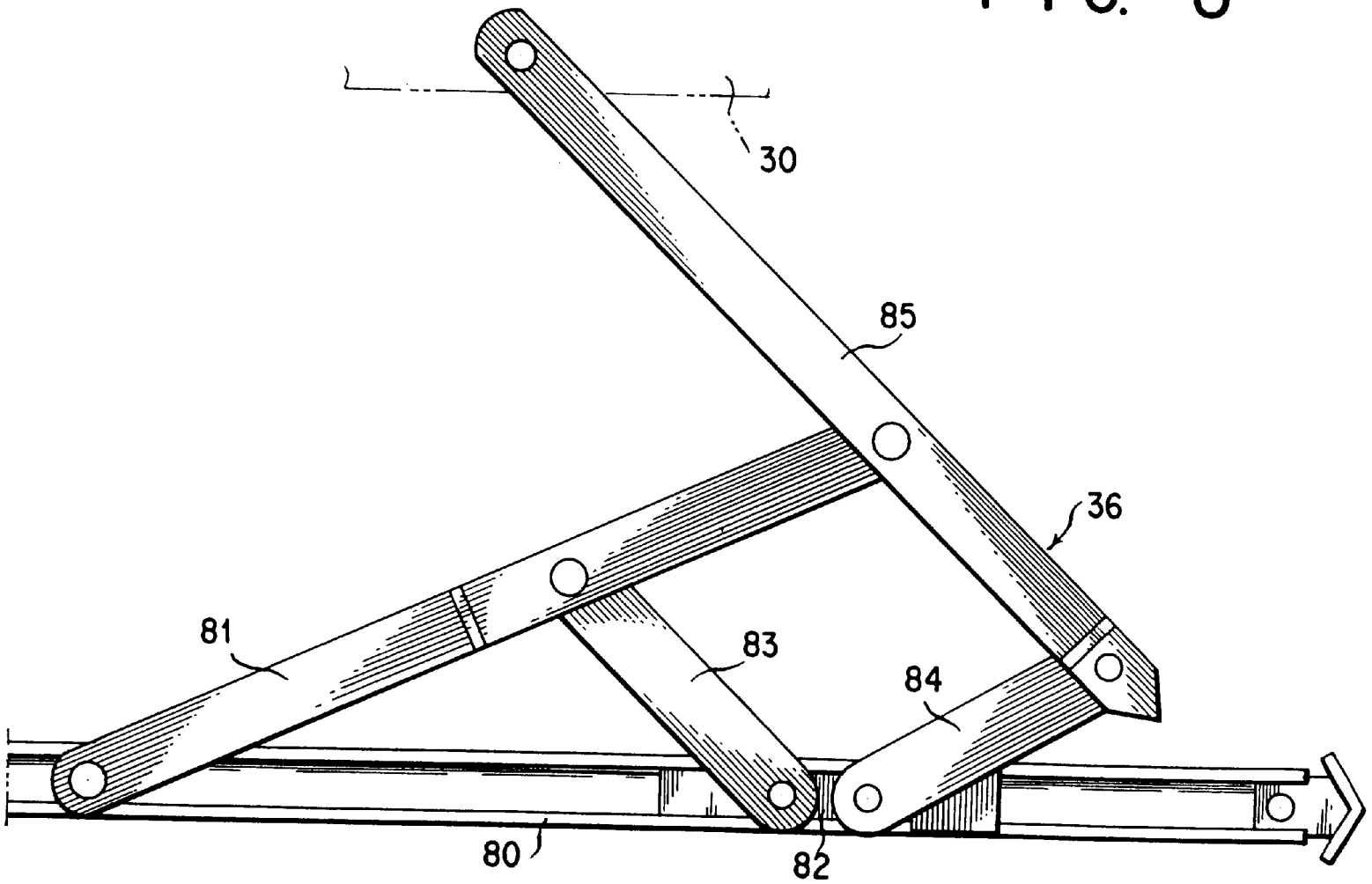
FIG. 8 is a plan view showing a pivot for projection or sliding out.

As shown in FIGS. 5 to 7, the lock body 61 has a casing 73 having a lid 71 fixed to a base plate 70 and having a guide groove 72, a slider 74 slidably provided within the guide groove 72, and a cam 75 rotatably provided on the base plate 70. To a square hole 76 of the cam 75, a square shaft (not shown) to be driven by the handle 60 is engaged. The tip end of the cam 75 is engaged with a recess 74*a* of the slider 74 for coupling the slider 74 with the cam. Thus, by rotating the cam 75, the slider 74 is moved slidingly along the guide groove 72.

As shown in FIG. 4, the base plate 70 is fixed on the interior side panel 53 by means of fastening screws to contact with a projection 53*b* provided on the inner face 53*a* so that the base plate 70 may not contact with the inner face 53*a*. By this, the slider 74 may smoothly slid away from the inner face 53*a*.

As shown in FIGS. 6 and 7, a projection 78 is formed on the periphery of screw hole 77 formed through the base plate 70. The projection 78 serves for positioning of the lock body 61 with engaging in the hole 79 of the interior side panel 53, as shown in FIG. 4.

The vertical projecting or sliding out hinge 36 includes a first lever 81 pivoted on a frame side member 80 for outward pivotal motion, a slider 82 slidably engaged with the frame side member 80 for sliding motion in the in-plane direction, second lever 83 and a fourth lever 84 are pivoted on the slider 82 for outward pivotal motion. The second lever 83 is pivotally connected with the first lever 81, and a fifth lever 85 is extended over the first lever 81 and the fourth lever 84 and connected to respective free ends of the first and fourth levers 81 and 84.

The frame side member 80 is mounted on the window frame 20. On the other hand, the tip end of the fifth lever 85 is pivotably connected to the window door.

Figure 9:
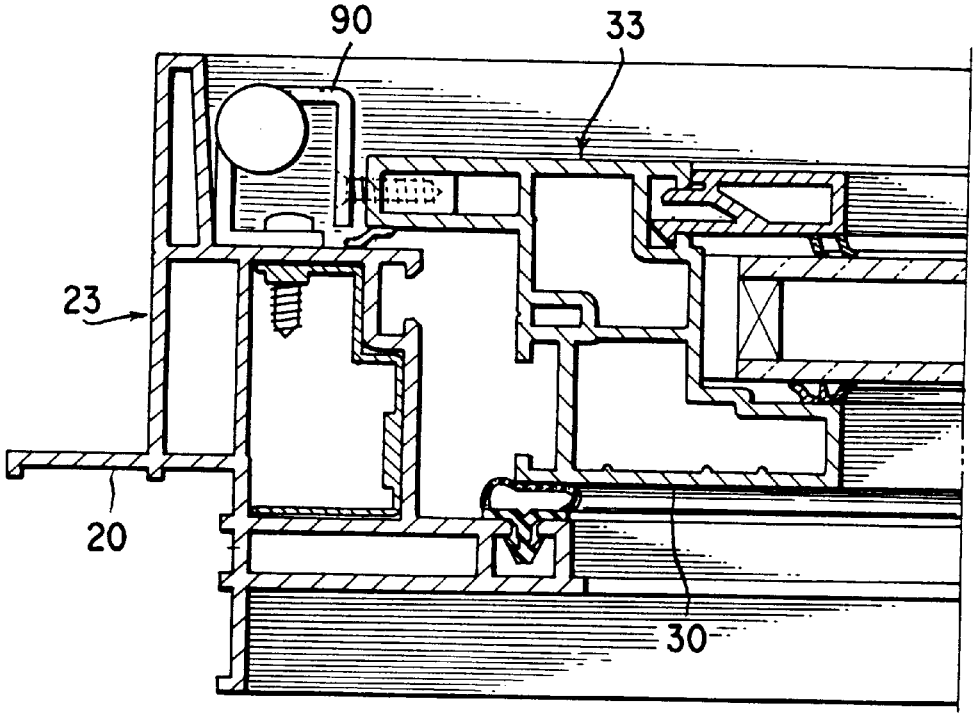
FIG. 9 is a cross section showing a mounting portion for the hinge.

It is also possible to mount the window door on the window frame 20 by means of a hinge 90 for outward pivotal motion, as shown in FIG. 9.

Figure 10:
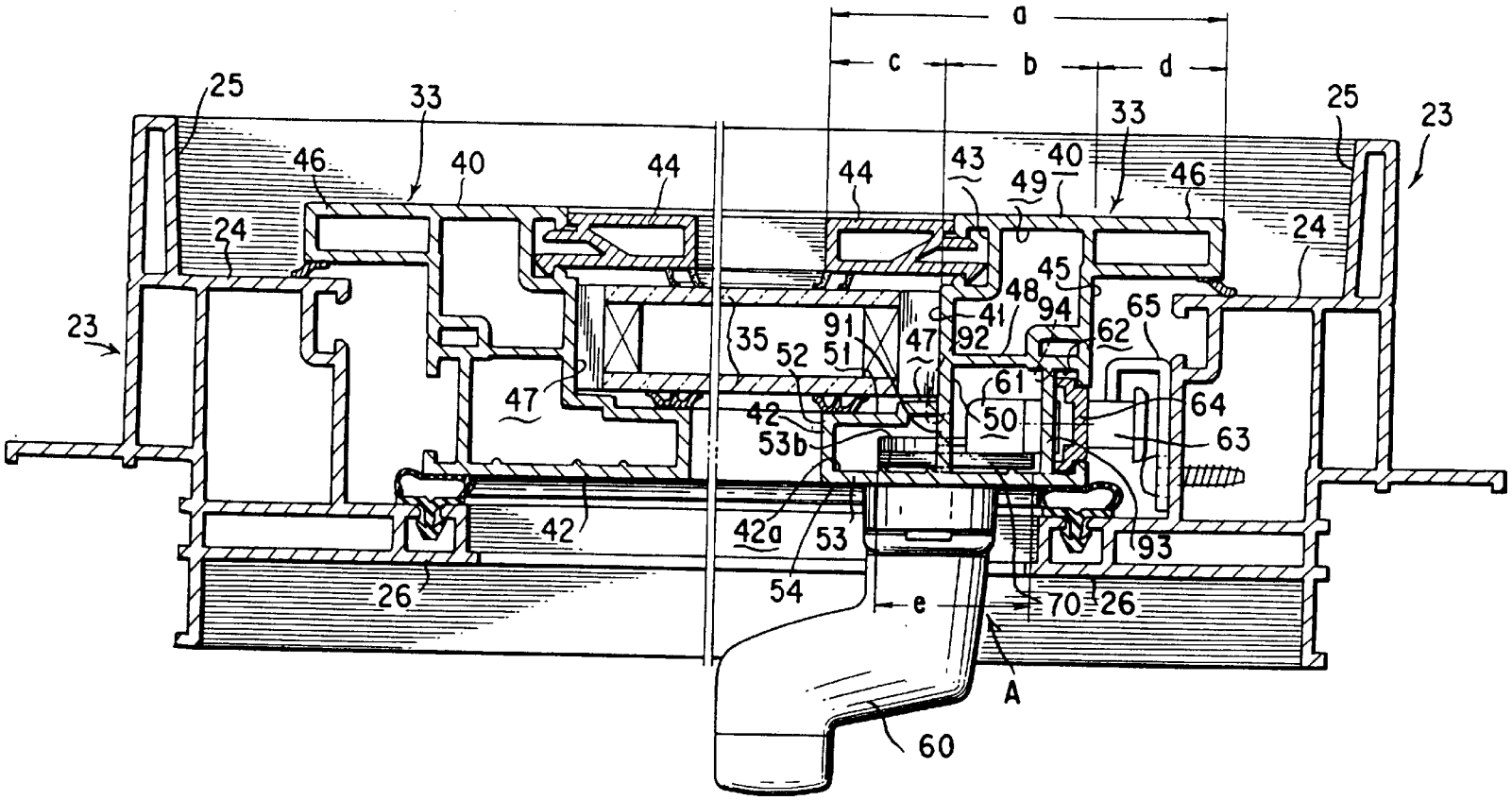
FIG. 10 is a cross section showing the second embodiment of the cremorne lock according to the present invention.

FIG. 10 shows the second embodiment of the cremorne lock mounting device according to the present invention. In the shown embodiment, the hollow portion 50 and the hollow portion 42*a* are separated by a connecting wall 91. A cut-out 92 is formed in the connecting wall 91 for mounting the lock body 61 over the hollow portion 50 and the hollow portion 42*a*. An outer side panel 93 in the width direction of the frame body 40 is formed with a cut-out 94 so that the lock body 61 may be inserted through the cut-out 94.

The components in the second embodiment other than those set forth above are the same as those in the former embodiment. Therefore, discussion for such common components are neglected for keeping the disclosure simple enough to facilitate clear understanding of the present invention.

As set forth above, according to the present invention, since the lock body is mounted over the hollow portion of the frame body and the hollow portion of one side panel support portion, the width dimension of the frame body can be smaller than the width dimension of the lock body. By this, the width dimension of the frame can be made smaller to provide greater lighting area for the window door.

Also, according to the present invention, since the lock body is mounted over the frame body and the one side frame support portion, the width dimension of the frame body can be smaller than the width dimension of the lock body. By this, the width dimension of the frame can be made smaller to provide greater lighting area for the window door.

Although the present invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed and equivalents thereof with respect to the feature set out in the appended claims.

What is claimed is:

1. A cremorne lock mounting device for a window comprising:

a frame body having a predetermined length and a cross-section thereby defining a first hollow portion;

the frame body having a first side panel support portion projecting inwardly in a width direction at an interior side of an inner surface of the frame body in the width direction, thereby defining a second hollow portion therein, the second hollow portion being formed integrally with the first hollow portion and in communication therewith;

the frame body having a second side panel support portion projecting inwardly in the width direction at an exterior side of the inner surface of the frame body in the width direction; and a lock body of the cremorne lock mounting device mounted over the first hollow portion and the second hollow portion in the frame body, a connecting wall separating the first hollow portion and the second hollow portion in the width direction, and the lock body of the cremorne lock being mounted over the frame body hollow portion and the first hollow portion in the frame body through a cut-out formed in the connecting wall.

2. The cremorne lock mounting device of claim 1, wherein the second side panel support portion is releasably engaged with a recessed groove formed on an exterior side on the inner surface in the width direction of the frame body.

3. The cremorne lock mounting device of claim 1, wherein the first side panel support portion is formed with an inwardly oriented panel integrally provided at an intermediate position in the width direction on the inner surface of the frame body and oriented inwardly, a depth direction oriented panel provided integrally with the inwardly oriented panel and oriented in the depth direction toward an interior side surface, and an interior side panel provided integrally with the depth direction oriented panel, oriented in the width direction from the interior side surface and extending to an outer surface of the frame body in the width direction.

4. The cremorne lock mounting device of claim 3, wherein the second side panel support portion is releasably engaged with a recessed groove formed on an exterior side on the inner surface in the width direction of the frame body.

5. A cremorne lock mounting device for a window comprising:

a frame body having a predetermined length and a cross-section, thereby defining a first hollow portion;

the frame body having a first side panel support portion projecting inwardly in a width direction at an interior side of an inner surface of the frame body in the width direction, thereby defining a second hollow portion therein, the second hollow portion being formed integrally with the first hollow portion and in communication therewith;

the frame body having a second side panel support portion projecting inwardly in the width direction at an exterior side of the inner surface of the frame body in the width direction; and a lock body of the cremorne lock mounting device mounted over the first hollow portion and the second hollow portion in the frame body, wherein the second side panel support portion is releasably engaged with a recessed groove formed on an exterior side on the inner surface in the width direction of the frame body.

6. A cremorne lock mounting device for a window comprising:

a frame body having a predetermined length and a cross-section thereby defining a first hollow portion;

the frame body having a first side panel support portion projecting inwardly in a width direction at an interior side of an inner surface of the frame body in the width direction, thereby defining a second hollow portion therein, the second hollow portion being formed integrally with the first hollow portion and in communication therewith;

the frame body having a second side panel support portion projecting inwardly in the width direction at an exterior side of the inner surface of the frame body in the width direction; and a lock body of the cremorne lock mounting device mounted over the first hollow portion and the second hollow portion in the frame body, wherein the first side panel support portion is formed with an inwardly oriented panel integrally provided at an intermediate position in the width direction on the inner surface of said frame body, a depth direction oriented panel provided integrally with the inwardly oriented panel and oriented in the depth direction toward an interior surface, and an interior side panel provided integrally with the depth direction oriented panel, oriented in the width direction from the interior side surface and extending to an outer surface of the frame body in the width direction.

7. The cremorne lock mounting device of claim 6, wherein the second side panel support portion is releasably engaged with a recessed groove formed on an exterior side on the inner surface in the width direction of the frame body.

* * * * *

UNITED STATES PATENT AND TRADEMARK OFFICE

CERTIFICATE OF CORRECTION

PATENT NO. : 6,065,248
DATED : May 23, 2000
INVENTOR(S) : Hiroyuki Sasaki et al.

It is certified that error appears in the above-identified patent and that said Letters Patent is hereby corrected as shown below:

Title page,
Item [30], in the Foreign Application Priority Data, "Jun. 30, 1997", should read -- Sept. 30, 1996 --.

Signed and Sealed this

Second Day of October, 2001

*Attest:*

Nicholas P. Godici

NICHOLAS P. GODICI
*Acting Director of the United States Patent and Trademark Office*

*Attesting Officer*